US010130155B2

(12) United States Patent
Ramet et al.

(10) Patent No.: US 10,130,155 B2
(45) Date of Patent: Nov. 20, 2018

(54) APPLICATOR HAVING A STEM CONNECTED TO AN APPLICATOR ELEMENT BY AN ARTICULATION

(71) Applicant: L'OREAL, Paris (FR)

(72) Inventors: Marc Ramet, Argenteuil (FR); Michel Limongi, Clichy (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 14/382,015

(22) PCT Filed: Feb. 25, 2013

(86) PCT No.: PCT/EP2013/053714
§ 371 (c)(1),
(2) Date: Aug. 29, 2014

(87) PCT Pub. No.: WO2013/127740
PCT Pub. Date: Sep. 6, 2013

(65) Prior Publication Data

US 2015/0020836 A1 Jan. 22, 2015

Related U.S. Application Data

(60) Provisional application No. 61/610,604, filed on Mar. 14, 2012.

(51) Int. Cl.
*A45D 34/04* (2006.01)
*A45D 40/26* (2006.01)

(52) U.S. Cl.
CPC ..... *A45D 34/04* (2013.01); *A45D 34/041* (2013.01); *A45D 34/042* (2013.01);
(Continued)

(58) Field of Classification Search
CPC .... A45D 34/04; A45D 34/041; A45D 34/042; A45D 34/045; A45D 34/046;
(Continued)

(56) References Cited

U.S. PATENT DOCUMENTS 2,173,959 A 9/1939 Britt
2,749,567 A * 6/1956 Krueger ..... A46B 5/0075 15/172

(Continued)

FOREIGN PATENT DOCUMENTS

CN 1343104 A 4/2002
CN 101843401 A 9/2010

(Continued)

OTHER PUBLICATIONS

International Search Report for PCT/EP2013/053714.

(Continued)

*Primary Examiner* — Tatiana Nobrega
(74) *Attorney, Agent, or Firm* — The Marbury Law Group, PLLC

(57) ABSTRACT

The present invention relates to an applicator comprising: —a gripping member (7), —a stem (6), of longitudinal axis X, connected by its first end to the gripping member (7), —an applicator element (20) connected to a second end of the stem (6) by an articulation comprising a ball joint (206), characterized in that the articulation comprises a rotation axis that coincides with the longitudinal axis X of the stem (6), and the stem (6) is in one piece, and the applicator element (20) is made of metal, ceramic or glass.

13 Claims, 4 Drawing Sheets

Figure 1:
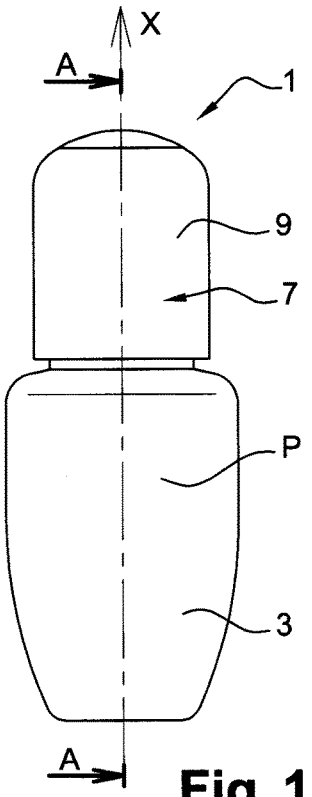

(52) U.S. Cl.
CPC ..... *A45D 34/045* (2013.01); *A45D 40/26* (2013.01); *A45D 40/261* (2013.01); *A45D 40/262* (2013.01)

(58) Field of Classification Search
CPC .... A45D 40/26; A45D 40/261; A45D 40/262; A45D 40/265; A45D 40/267; A45D 40/264; A45D 34/043; A61H 7/003; A61H 7/007; A61H 2015/0007; A61H 2201/0153; A61H 2201/0157; A61H 2201/1253
USPC .... 401/126, 127, 128, 130, 219; 601/18, 19, 601/84, 94, 112, 113, 118, 134–137
See application file for complete search history.

(56) References Cited

U.S. PATENT DOCUMENTS

| | | | | |
|---|---|---|---|---|
| 3,185,291 | A | 5/1965 | Lerner | |
| 4,165,755 | A * | 8/1979 | Cassai | A45D 40/265 132/218 |
| 4,370,989 | A | 2/1983 | Taylor | |
| 4,396,028 | A | 8/1983 | Waggoner | |
| 4,428,388 | A | 1/1984 | Cassai et al. | |
| D285,125 | S * | 8/1986 | Cassai | D28/7 |
| 5,328,282 | A * | 7/1994 | Charrier | A45D 34/048 401/127 |
| 5,391,011 | A | 2/1995 | Gueret | |
| 5,435,328 | A | 7/1995 | Grohoske | |
| 6,026,823 | A | 2/2000 | Gueret | |
| 6,616,366 | B1 * | 9/2003 | Weihrauch | A45D 34/043 132/216 |
| 7,678,066 | B2 * | 3/2010 | Habatjou | A45D 34/041 401/209 |
| 8,689,808 | B2 | 4/2014 | Gueret | |
| 8,783,989 | B2 | 7/2014 | Weigel et al. | |
| 2001/0053305 | A1 | 12/2001 | Berke et al. | |
| 2004/0009028 | A1 * | 1/2004 | Gueret | A45D 40/265 401/129 |
| 2005/0238408 | A1 | 10/2005 | Ramet | |
| 2006/0054179 | A1 | 3/2006 | Kuzuu | |
| 2006/0272670 | A1 * | 12/2006 | Gueret | A45D 34/042 132/317 |
| 2007/0062552 | A1 * | 3/2007 | De Brouwer | A45D 34/045 132/218 |
| 2007/0186951 | A1 * | 8/2007 | Gueret | A45D 34/00 132/320 |
| 2007/0206986 | A1 * | 9/2007 | Gueret | A45D 34/04 401/123 |
| 2010/0269842 | A1 | 10/2010 | Gueret | |
| 2011/0110701 | A1 * | 5/2011 | Gueret | A45D 40/265 401/126 |
| 2011/0135376 | A1 * | 6/2011 | Weigel | A45D 40/24 401/29 |
| 2011/0176856 | A1 * | 7/2011 | Gardner | A45D 40/265 401/195 |

FOREIGN PATENT DOCUMENTS

| | | | |
|---|---|---|---|
| CN | 102085042 | A | 6/2011 |
| EP | 2243393 | A1 | 10/2010 |
| EP | 2329742 | A1 | 6/2011 |
| FR | 1395217 | A | 4/1965 |
| FR | 2701196 | A1 | 8/1994 |
| FR | 2753056 | A1 | 3/1998 |
| FR | 2840514 | A1 | 12/2003 |
| FR | 2851138 | A1 | 8/2004 |
| JP | 10-099127 | A | 4/1998 |

OTHER PUBLICATIONS

English language Abstract for FR 2851138.
English language Abstract for JP 10-099127.
English machine translation of FR 1395217A (Apr. 9, 1965).
Machine Translation of First Office Action for Chinese Application No. 201380022593.5, dated May 4, 2016.
Machine Translation of Second Office Action for Chinese Application No. 201380022593.5, dated Jan. 6, 2017.

* cited by examiner

APPLICATOR HAVING A STEM CONNECTED TO AN APPLICATOR ELEMENT BY AN ARTICULATION

This is a national stage of international application No. PCT/EP20053714, filed on Feb. 25, 2013, which claims priority to U.S. Provisional Application No. 61/610,604, filed on Mar. 14, 2012, and French Application No. 1251846, filed Feb. 29, 2012. All of the above-mentioned applications are expressly incorporated herein by reference in their entireties.

The present invention relates to applicators comprising a gripping member, a stem and an applicator element disposed at one end of the wand.

Applicators of this type, which are suitable for the application of a cosmetic product, are described in the patents U.S. Pat. Nos. 6,026,823, 5,328,282, 2,173,959, 4,396,028, 5,435,328, FR 2 701 196, US Pat. No. 4,165,755, FR 1 395 217, U.S. Pat. Nos.4,428,388, 3,185,291 and U.S. Pat. No. 4,370,989.

Applicators for makeup or care product that are able to move with respect to the gripping means are known. For example, the document FR 2 753 056 discloses an applicator comprising a product reservoir, a removable cap and a wand. The stem is secured to the cap by an articulation that allows an angular movement with a maximum range of less than or equal to 90°.

The documents FR 2 840 514 and U.S. Pat. No. 4,165,755 describe an applicator comprising a gripping member, a stem connected to the gripping member by an articulation, and an applicator element. The articulation separates the stem into two portions. A first portion is connected to the applicator element. A second portion is connected to the gripping means.

In FR 2 840 514 and in the first two embodiments of the applicator according to U.S. Pat. No. 4,165,755, the two stem portions are articulated by a pivot linkage. The first portion of the stem describes, with respect to the second portion, a movement in a plane perpendicular to the rotation axis. The longitudinal axis of the second stem portion passes through this plane.

In the third embodiment of the applicator according to U.S. Pat. No. 4,165,755, the two stem portions are articulated by a ball joint linkage.

The drawback of this type of applicator is that the applicator element can be oriented only by way of the wand. It is difficult to achieve precision in this orientation, even if the articulation is close to the applicator element. In all cases, the applicator is lacking in degrees of freedom. For example, with this type of applicator, it is not possible to massage the face.

Another drawback resides in that fact that the applicator element is not free to move under the effect of its own weight.

The document U.S. Pat. No. 5,435,328 describes an applicator mounted on a ball joint without play at one end of a wand. The other end of the stem is connected to the gripping means. The articulation axis of the ball joint is perpendicular to the longitudinal axis of the wand.

The document US2011/0176856 describes an applicator that pivots about an axis perpendicular to the longitudinal axis of the wand. The axis of the applicator can be located in line with the longitudinal axis of the wand. It may deviate from this axis by more than 90° in the two directions of rotation.

These applicators lack precision and fluidity in their movement.

The invention aims to provide an ergonomic cosmetic applicator which improves the making up or caring, while also carrying out a pleasant and fluid massage, running smoothly over the area of the body in question. The movement must be able to be continuous, regular and without jerking or jolting.

In particular, the invention relates to an applicator that is more flexible and more precise to handle, by way of which the user can also more easily reach all the parts of the face without constraint. It must also be able to lightly massage areas of the face that are more delicate or are more marked by tiredness.

The subject of the invention is an applicator comprising:

- a gripping member,
- a wand, of longitudinal axis X, connected by its first end to the gripping member,
- an applicator element connected to a second end of the stem by an articulation comprising a ball joint,
- the articulation comprises a rotation axis that coincides with the longitudinal axis X of the wand, and
- the stem is in one piece, and
- the applicator element is made of metal, ceramic or glass.

According to the invention, it is preferably chosen an applicator element capable of storing and retaining thermal energy.

The applicator preferably has high thermal capacities. The applicator element may transfer a cool sensation to the user's skin.

This applicator provides fluidity of movement on application, pleasant hand movements and can be oriented in all the desired directions without resistance.

Within the meaning of the invention, the term "ball joint" is understood to mean an articulation formed from a spherical component that can rotate in a hollow housing.

The ball joint linkage is identified by its degrees of freedom: it completely links two components in translation but leaves them free to rotate. It comprises three degrees of linkage (the three translations) and three degrees of freedom (the three rotations). The simplest case is that of two, male and female, spheres. There is no preferred direction from the point of view of behavior. There is only one schematic representation, inasmuch as no direction can be distinguished. When two components are linked by a ball joint, there is a fixed point of one component that coincides with a fixed point of the other component. This point is the center of the connection.

A "ball joint linkage" is distinguished from a "pivot linkage". The latter guides a component in rotation, only allowing rotation about the axis of the linkage. When two solids are in a pivot linkage, there are at least two fixed points of each solid that coincide in each case. The straight line passing through these points constitutes the axis of the linkage. It comprises three degrees of linkage (the three translations) and a single degree of freedom (one rotation).

A "one-piece wand" is understood to be a stem formed from a single part or from a single block. The stem is not articulated. It is not separated into two stem portions: one portion comprising the gripping member and the other portion comprising the applicator element. A stem as defined in FR2840514 or in U.S. Pat. No. 4,165,755 is not a one-piece wand. According to the invention, no stem portion can, for example, form the core of the applicator element or form the free end of the applicator element.

The expression "axial movement of the applicator element" is understood to mean a movement of the latter in the direction of the longitudinal axis of the wand.

The expression "lateral movement of the applicator element" is understood to mean a movement of the latter perpendicularly to the longitudinal axis of the wand.

The expression "hollow housing (or seat), complementary to the ball joint" is understood to mean a cavity in which the ball joint sits, this cavity being configured such that, in the state of equilibrium of the articulation, more than 30% of the surface of the ball joint is facing a spherical surface of the cavity, preferably more than 60%, and more preferably more than 80%.

The Articulation

Advantageously, the articulation consists of a spherical ball joint fixed to one end of the applicator element, and of a hollow housing (or seat), complementary to the ball joint, located at a first end of the wand. This configuration is simple to produce and to use.

Preferably, the spherical ball joint is force-fitted into the hollow housing. This fitting is rapid, secure and effective.

According to another embodiment of the invention, the articulation consists of a spherical ball joint fixed to a first end of the wand, and of a hollow housing (or seat), complementary to the ball joint, located at one end of the applicator element.

In this other embodiment, the spherical ball joint of the stem is force-fitted into the hollow housing of the applicator element.

More preferably, the hollow housing is made of plastics material. This choice of material for the hollow housing makes it possible to adjust rubbing and slows down wear.

Even more preferably, the ball joint is made of metal. This choice of material also helps to increase the service life of the articulation.

More advantageously, the articulation is designed to prevent substantial axial and/or lateral movement of the applicator element in relation to the wand.

The absence of axial and/or lateral movement of the applicator element in relation to the stem in the region of the articulation can enable the user to precisely position the applicator element at the location where the product is intended to be applied.

The articulation may comprise a brake for braking the movement of the applicator element with respect to the wand. The brake can exert a braking action regardless of the position of the applicator element in relation to the wand. Alternatively, it is possible for the brake only to exert a braking action in at least one predetermined position of the applicator element in relation to the wand. For example, the brake is a clamp.

The applicator may be designed in such a way that the applicator element maintains the orientation it is given by the user when the latter releases it.

The applicator may also comprise an elastic return means suitable for returning the applicator element into a predetermined orientation when the user releases it, for example in order to align its axis with that of the wand. This return member may consist for example of a constituent element of the articulation. The return member may consist of a sheath and/or of a return lug.

The Applicator Element

The applicator element may comprise a massage element comprising a substantially smooth outer surface, such as a ball. Alternatively, the outer surface may also be provided with irregularities, such as sculptures in relief, in particular if the massage is carried out in order to abrade epidermal tissue.

Preferably, the applicator element is able to move under the effect of a force of between 0 N and 0.4 N, preferably between 0.01 N and 0.02 N. More preferably, the applicator element is able to move under the effect of its own weight.

Advantageously, there is no rubbing or friction between the applicator element and the seat.

Even more preferably, the applicator element is in one piece. For example, it may be in the form of a sphere, a rugby ball or a tear equipped with a ball joint. In particular, the applicator element has no core, and in particular it has no core that realizes its longitudinal axis.

The applicator element is in particular made of aluminum, titanium, steel, stainless steel, nickel, tin, copper, brass, alloys thereof.

It may comprise at least one material chosen among metal, ceramic and glass.

Advantageously, the applicator element is made of metal. It provides a sensation of freshness, which improves the well-being and relaxation of the person, while increasing the effectiveness of the product applied.

(i) Mass of the Applicator Element

Preferably, the applicator element has a mass of at least 0.8 grams and at most 6 grams.

More preferably, the applicator element has a mass of at least 2 grams and at most 4 grams.

Even more preferably, the applicator element has a mass of at least 2.5 grams and at most 3.5 grams.

(ii) Density of the Applicator Element

Preferably, the applicator element has a density of at least 7.5 and at most 8.5.

More preferably, the applicator element has a density of at least 7.9 and at most 8.1.

(iii) Specific Heat Capacity

The specific capacity is the amount of heat required to raise the temperature of 1 kg of a substance through 1K.

It is measured by the standard technique of calorimetric.

Preferably, the applicator element has a specific heat capacity of at least 300 $Jkg^{-1}K^{-1}$ and at most about 1200 $Jkg^{-1}K^{-1}$.

More preferably, the applicator element has a specific heat capacity of at least 400 $Jkg^{-1}K^{-1}$ and at most about 1100 $Jkg^{-1}K^{-1}$.

Even more preferably, the applicator element has a specific heat capacity of at least 500 $Jkg^{-1}K^{-1}$ and at most about 1000 $Jkg^{-1}K^{-1}$.

(iv) Contact Between the Applicator Element and the Skin of the User

According to the invention, the applicator element made of metal, glass or ceramic is directly in contact with the skin of the user.

In particular, an applicator including an applicator element with:

A core made of metal, glass or ceramic, and

Tooth made of another material than metal, glass or ceramic, does not belong to the present invention.

The applicator element may be able to hold product by capillary action.

The applicator element may have a rectilinear or curved axis, and preferably the axis is rectilinear in order to adapt better to the articulation.

Packaging and Application Device

Another subject of the invention is a device for packaging and applying a cosmetic product, comprising a container containing the product and an applicator as defined above, the applicator closing the device and the applicator element being inside the container in the closed position.

The applicator may be designed to close the container.

The container may comprise a wiper. The wiper may make it possible to move the stem into a position in which it has zero inclination when the applicator is moved onto the container.

The container and the applicator may be designed such that the stem the applicator is prevented from pivoting in relation to the container when the applicator is put in place on the latter.

A sealed closure of the container can be obtained by sealing means located above the articulation.

The cosmetic product may be in particular a body care product or a facial care product, a makeup product or a hygiene product. In particular, the cosmetic product may be a moisturizing care product, an anti-wrinkle product, a foundation, a gloss, a lip balm, a lipstick, or an eyeshadow.

Picking Up of the Cosmetic Product

According to a first embodiment of the invention, the product is picked up from a container by bringing the applicator element into contact with the product. The latter can adhere temporarily to the surface of the applicator element before being deposited on the skin. Optionally, there may be a zone for retaining cosmetic product between the stem and the applicator element or even within the applicator itself The cosmetic product is temporarily stored in this zone before being deposited onto the body surface.

According to a second embodiment of the invention, the applicator comprises a pipette. The cosmetic product is picked up from the container by being drawn through a duct passing through the stem and optionally the applicator element. The duct comprises at least one orifice that leads onto the surface of the stem or of the applicator element. The product flows through this duct and can be temporarily stored therein, in particular in the portion of the duct located inside the wand.

The product is drawn through the orifice that leads onto the surface of the applicator element on account of the negative pressure created in the duct. It passes through the duct in the applicator element and is directed toward the duct in the wand, even if the applicator element is inclined with respect to the latter. It can be stored in the duct in the stem or in a reservoir that leads into this duct.

When a positive pressure is created in the wand, the product follows exactly the opposite path. In this case, the product is expelled from the applicator element after it has passed into the duct in the applicator element.

The gripping means linked to the applicator may comprise a flexible, elastically deformable wall, thereby allowing the user to create a negative pressure therein in order to draw the product into the duct, and then a positive pressure in order to expel it out of the duct and drive it in particular toward the body surface.

Alternatively or in addition, the duct may lead through at least one lateral orifice in the applicator element, this lateral orifice being for example located between two massage elements or between two teeth or bristles when the applicator element comprises at least one series of teeth or bristles.

The cross-sectional area of the duct passing through the applicator element and that of the duct passing through the stem may be produced with different cross sections, so as to avoid leaks of product or clogging.

Application Method

A further subject of the invention is a method for applying a cosmetic product to a part of the body or face, characterized in that it comprises the following steps of:

- loading the applicator element of an applicator as defined above with a cosmetic product,
- bringing the applicator element into contact with a body surface,
- moving the applicator in order to sweep an area of the body,
- modifying the orientation of the applicator element with respect to the stem by changing the pressure exerted on this element, in order to massage the area of the body.

When the applicator element is designed to apply a product to a particularly sensitive area, such as an eye contour area, the method may comprise the following steps of:

- positioning the end of the applicator element such that it rests under one eye and aligning the axis of the stem with that of the applicator element, bringing the stem into a substantially horizontal position,
- turning the stem about its axis,
- with the applicator element at a first inclination in relation to the wand, rotating the applicator element about a first axis, in particular an axis perpendicular to the area,
- with the applicator element at a second inclination, different from the first, in relation to the wand, rotating the applicator element about a second axis, in particular an axis not perpendicular to the area,
- changing the resting point.

Figure 2:
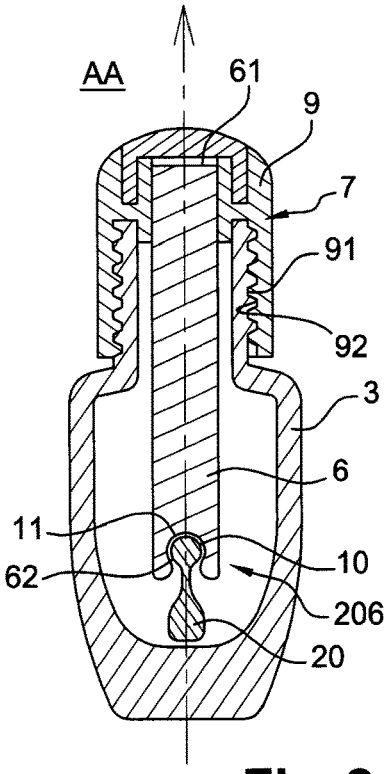
Figure 3:
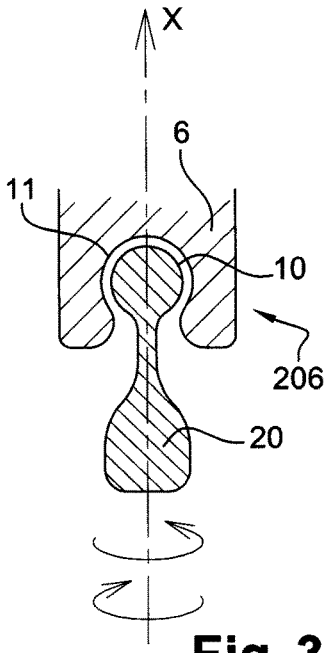
Figure 4:
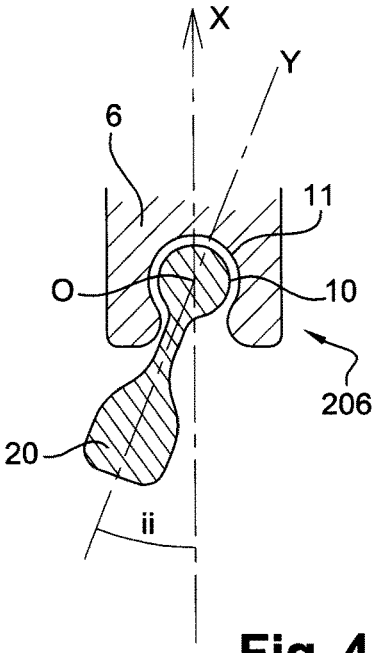
Figure 5:
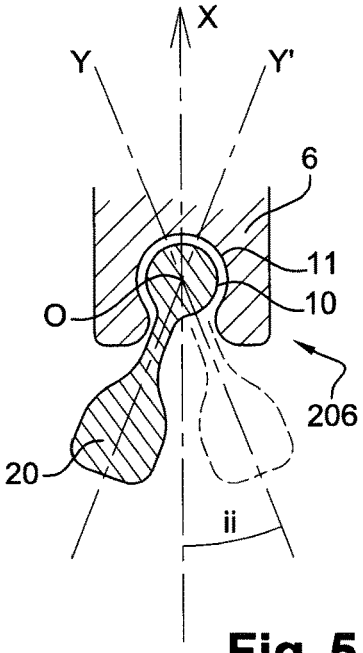
Figure 6:
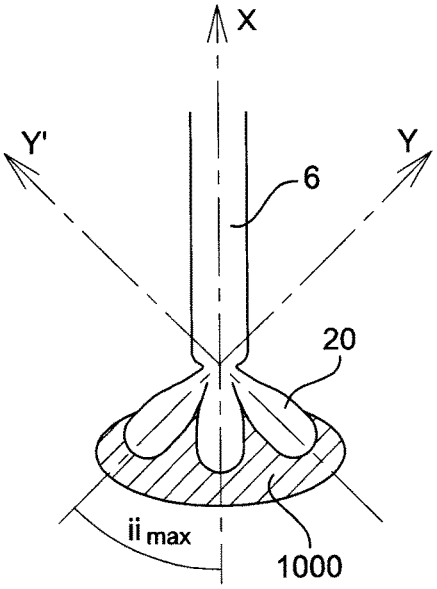
Figure 7:
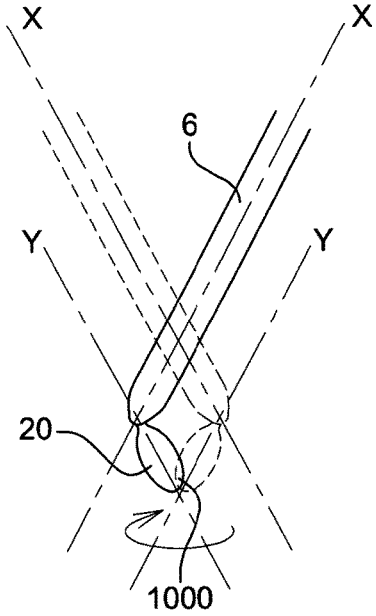
Figure 8:
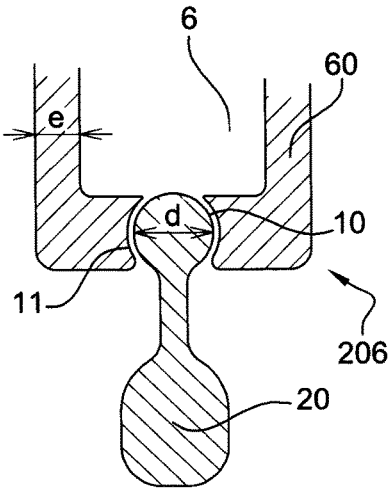
Figure 9:
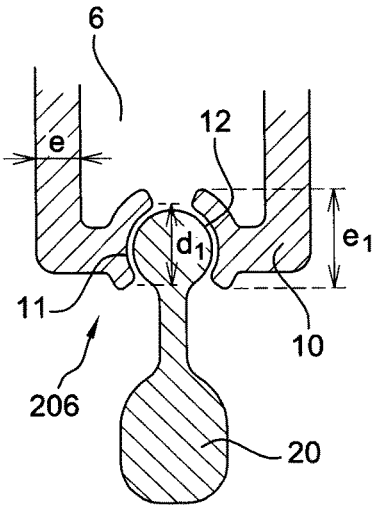
Figure 10:
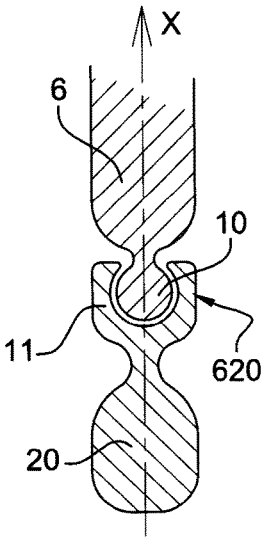
Figure 11:
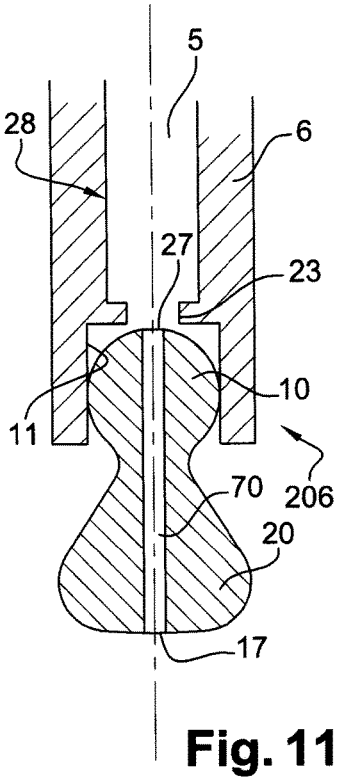
Figure 12:
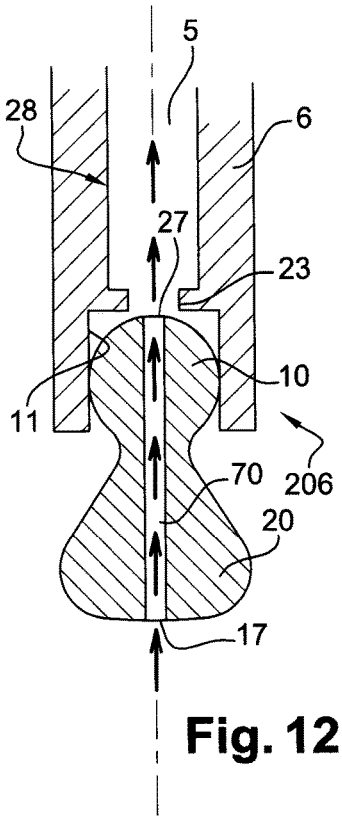
Figure 13:
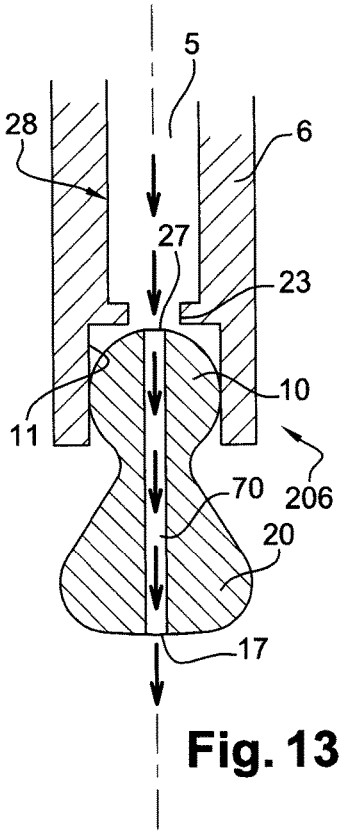
Figure 14:
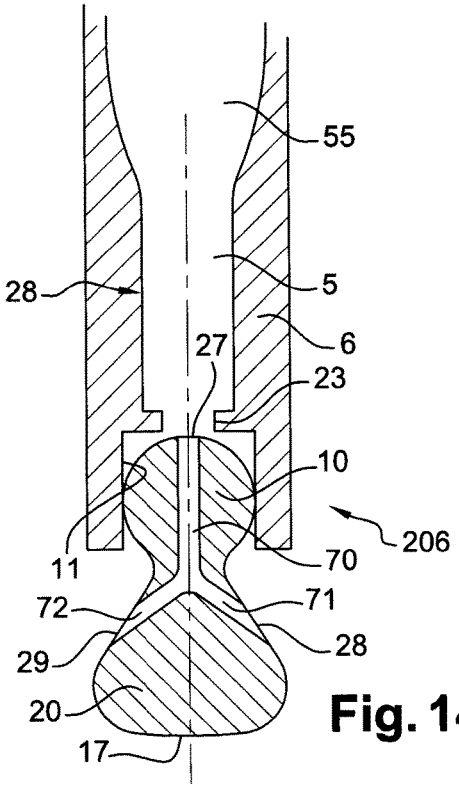
Figure 15:
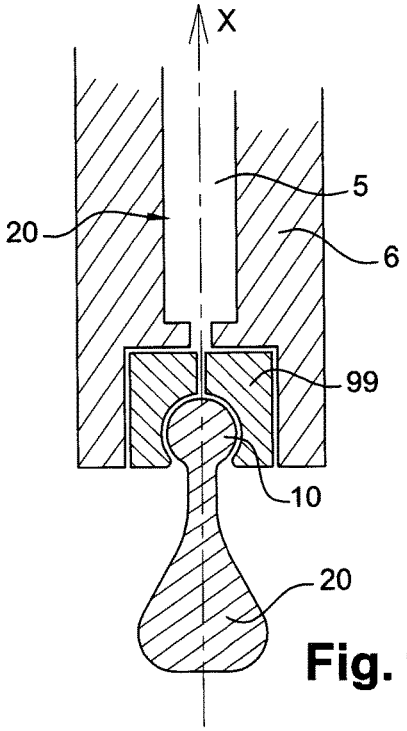
Figure 16:
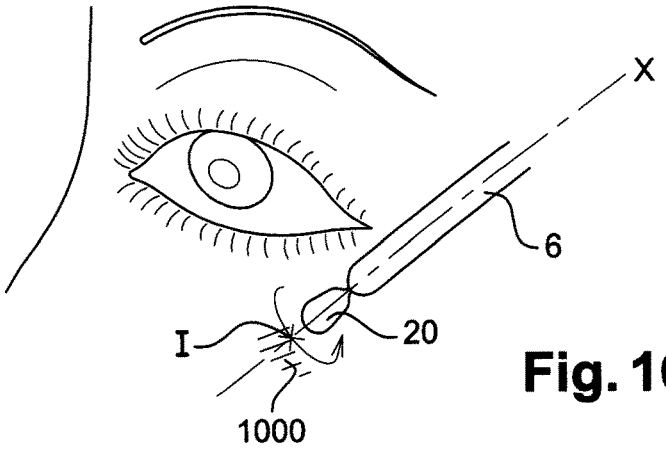
Figure 17:
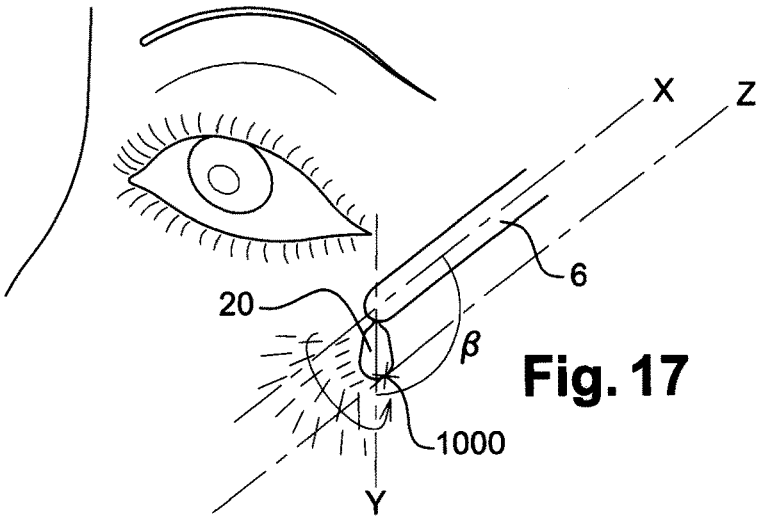
Figure 18:
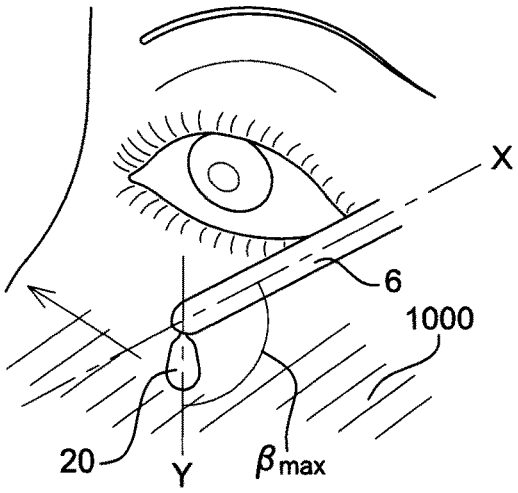

The invention may be better understood from reading the following detailed description of non-limiting implementation examples and from examining the appended drawing, in which:

FIG. 1 is a schematic front view of a device produced in accordance with the invention, FIG. 2 shows a cross section AA of the device from FIG. 1, FIG. 3 shows, on its own, the ball joint articulation of the applicator of the device from FIG. 2, after the stem has been pivoted in relation to the gripping member, FIG. 4 shows, on its own, the ball joint articulation of the applicator of the device from FIG. 2, after the applicator element has been pivoted in relation to the wand, in cross section AA, FIG. 5 shows, on its own, the ball joint articulation of the applicator of the device from FIG. 2, in two rotary positions of the applicator element in relation to the wand, in cross section AA, FIG. 6 illustrates the field of action of the applicator element in a fixed position of the wand, the rotation axis of the applicator coinciding with the axis of the wand, in cross section AA, FIG. 7 illustrates a rotary movement of the applicator, starting from a resting point of the applicator element, with the stem oriented approximately vertically, in cross section AA, FIGS. 8 to 10 show various examples of ball joint articulations, in cross section AA, FIG. 11 is a longitudinal section through an applicator according to the invention having a pipette function, in cross section AA, FIG. 12 illustrates the path of the cosmetic product drawn through an applicator according to the invention having a pipette function, in cross section AA, FIG. 13 illustrates the path of the cosmetic product expelled from an applicator according to the invention having a pipette function, in cross section AA, FIG. 14 is a longitudinal section through an applicator according to the invention having a pipette function, comprising two ducts that lead out of the applicator element, in cross section AA, FIG. 15 is a longitudinal section through an applicator according to the invention provided with an intermediate part that makes it easier to assemble, FIGS. 16 to 18 illustrate the use of the applicator according to the invention for eye contour care.

The device 1 shown in FIGS. 1 and 2 is intended for the application of a product P to the face or body, for example a moisturizing cream. It comprises a container 3 containing the product P, and an applicator 7. The applicator is fixed in a more or less sealed manner on the container when not in use. To this end, the container 3 may comprise, in a conventional manner, a threaded neck 92.

The applicator 7 comprises a stem 6, a gripping member 9 and an applicator element 20. The wand, the applicator member and the applicator element may be aligned along the same longitudinal axis X. The gripping member 9 forms a closure cap for the container 3. To this end, it is provided with an internal thread 91 configured to be screwed onto the threaded neck 92 of the container 3.

The stem 6 and the member 9 may be obtained by molding a thermoplastic material chosen from polyolefins, polypropylenes (PP), polyethylene terephthalates (PET) or a high density polyethylene (HDPE). The thermoplastic material may be introduced into the mould by injection.

The stem 6 is connected to the gripping member 9 in a fixed manner by a first end 61. It is connected to the applicator element 20 by a ball joint articulation 206 located at a second end 62.

FIGS. 3 to 5 show the ball joint articulation 206. It comprises a generally spherical part 10 formed on the applicator element 20 and a housing or seat 11, having a corresponding shape, inside the stem 6. Such a ball joint allows rotation of the applicator element 20 on itself, about its axis X, in relation to the stem 6, following the arrow shown in FIG. 3. Of course, the rotation may take place in the clockwise or counterclockwise direction.

The axis Y of the applicator element may be inclined with respect to the axis of the wand, for example in order to take up the position of the axis Y'. This is because the applicator element 20 is maneuverable and can be oriented in relation to the stem 6.

The angle ii formed between the axis X of the stem 6 and the axis Y of the applicator element may be modified by the user. In FIGS. 4 and 5, the applicator element is off-axis to one side and the other of the axis X.

FIG. 6 shows the area swept by the applicator element when the longitudinal axis Y of the latter is inclined an angle $ii_{max}$ with respect to X and when the applicator element is set into rotation about X, maintaining this inclination. The extent of the swept area 1000 is the projection of the cone formed by the axes Y on the body surface. Of course, the greater the angle $ii_{max}$, the larger the surface area of the disk projected by the cone.

The change in orientation of the stem 6 in relation to the applicator element 20 is illustrated in FIG. 7. The area 1000 swept by the applicator element may be practically point-like, if the user brings about this configuration, but it may be different therefrom, depending on the desired massage effect. FIG. 7 illustrates, for example, micro-massage over a target area.

In the examples in FIGS. 8 and 9, ball joint articulations comprising two different seats 11 are shown. In the two cases, in the state of equilibrium of the articulation, more than 30% of the surface of the ball joint is facing a spherical surface of the cavity. These two articulations are in accordance with the invention.

In FIG. 8, the seat is formed by a spherical cavity hollowed out in the wall 60 of the stem 6. The thickness e of the wall 60 is equal to the diameter d of the ball joint. The ball joint is force-fitted into this cavity, with the desired play, as between the two jaws of a pair of pliers.

In FIG. 9, the seat is formed by a spherical cavity having a diameter $d_1$ greater than the thickness e of the wall 60. The ball joint is force-fitted into this cavity, with the desired play. The ball joint 10 is forcibly kept between the two jaws 12 of the cavity 11. Since the thickness $e_1$ of the jaws 12 is greater than $d_1$, the surface of the ball joint facing the cavity is greater in this FIG. 9 than in FIG. 10.

In FIG. 10, the configuration of the linkage 620 is reversed. The spherical ball joint 10 is positioned at one end of the stem 6. The cavity 11 is located at one end of the applicator element 20. With this configuration, notable mobility of the applicator element 20 is likewise obtained.

FIG. 11 shows an applicator that also plays the role of a pipette. The applicator is identical to the one shown in the preceding figures, apart from the fact that it additionally comprises a duct 88 that serves to draw in and expel the cosmetic product.

This duct 88 passes through the stem 6 and the applicator element 20. It comprises:

- A portion 5 hollowed out in the wand. This portion passes through the wand. It ends at an orifice 25 at the end of the cavity 11. The longitudinal axis of this portion coincides with the axis X.
- A portion 70 hollowed out in the applicator element 20. This portion passes through the applicator element. It ends at an orifice 27 at the end of the ball joint and at an orifice 17 at that end of the applicator element that is intended to come into contact with the skin. In the aligned position of the stem and the applicator element, the longitudinal axis of this portion coincides with the axis X.

FIG. 12 illustrates by way of arrows the path followed by the product as it is drawn through the pipette. The product passes into the applicator element through the orifice 17, passes through the applicator element through the duct 70 and leaves this element through the orifice 27. It is joined to the portion 5 by the end 25. It can be stored in the portion 5.

In FIG. 13, the product is expelled from the pipette by following the route of the arrows, in the aligned position of the applicator element and the wand. The product leaves the stem through the orifice 25 in the portion 5. It passes into the applicator element through the orifice 27, passes through the applicator element through the duct 70 and leaves this element through the orifice 17.

In FIG. 14, the applicator additionally comprises a widened zone 55 located in line with the portion 5. This widened zone serves as a reservoir for storing product. It makes drawing in more effective. In addition, the element 20 comprises two secondary ducts 71 and 72 that form offshoots from the main duct 70. These ducts 71 and 72 lead out of the element through the orifices 28 and 29. The duct 70 could have more offshoots, for example a multiplicity of offshoots. The advantage of multiplying the secondary ducts is that the distribution of the product to the surface of the applicator is improved. By multiplying the ducts, the applicator can release the product in the manner of a sponge.

In FIG. 15, the applicator comprises an intermediate part 99 located between the seat 6 and the ball joint 10. This intermediate part 99 makes it easier to produce the applicator. This is because, instead of fitting the ball joint 10 directly into the seat 6 of the applicator, said ball joint is first of all fitted into the part 99. Next, this assembly, formed by the part 99 and the ball joint 10, is arranged in the seat 6, for example by force-fitting, by clamping or by snap-fastening.

FIGS. 16 to 18 show examples of the use of the applicator. Each figure is associated with a hand movement of the person. She can prefer point-wise massage, local massage or care.

The applicator is used for eye contour care. During such care with the stem of the applicator oriented downward (FIG. 16), the angle formed between the stem and the normal to the area of the face can be relatively high, in order to keep the stem away from the eye and to make hand movements easier. In the example shown, this angle is around 45°.

Once the applicator element has been loaded with the product, the person applies the element 20 close to the eye. She brings the stem 6 in line with the element 20 and aligns the longitudinal axes of the stem and the element. She turns the stem and the applicator element on themselves as per the arrow shown in FIG. 16. She thus carries out practically point-like massage at a location she has chosen, for example on account of its sensitivity. The area massaged is the area 1000 centered on the point of contact I between the axis X and the skin.

The person can likewise maintain this point of contact I with the skin while offsetting the stem 6. She brings about an inclination 13 between the axis X of the stem and the axis Y of the element 20. She can turn the element 20 about the axis Z, which is the normal to the skin passing through I, with this inclination β. The area massaged is enlarged to the surface 1000 indicated in FIG. 17.

In FIG. 18, the person moves the element 20 in translation with respect to the skin. $\beta_{max}$ is for example the maximum inclination between the axis X of the stem and the axis Y of the element 20. The person offsets the stem in order to obtain this inclination, then moves the stem 6 parallel to the contour of the eye, sliding the element 20 over the skin along the arrow. The area 1000 is enlarged at will. The element 20 rubs on the skin. It is moved by sliding in the desired direction when the user exerts a sufficient force on the gripping means to overcome this resistance.

The invention claimed is:

1. An applicator comprising:
- a gripping member;
- a stem defining a longitudinal axis, where a first end of the stem is connected to the gripping member; and
- an applicator element connected to a second end of the stem by an articulation comprising a ball joint linkage and a rotation axis that coincides with the longitudinal axis of the stem,
- wherein the stem is in one piece, and
- wherein:
- the applicator element comprises:
  - a ball joint or complementary ball housing at a first portion of the applicator element, and
  - a massage element at a second portion of the applicator element different from the first portion, wherein the massage element comprises a substantially smooth outer surface; and
- the applicator element is made of metal, ceramic or glass and the applicator element is in one piece;
- wherein the applicator element is configured to be movable in relation to the longitudinal axis of the stem under the effect of its own weight.

2. The applicator according to claim 1, wherein the applicator element has a mass of at least 2.5 grams and at most 3.5 grams.

3. The applicator of claim 1, wherein the applicator element has a specific heat capacity of at least 500 $Jkg^{-1}K^{-1}$ and at most about $1000Jkg^{-1}K^{-1}$.

4. The applicator of claim 1, wherein the applicator element is movable under a force ranging up to 0.4 N.

5. The applicator of claim 4, wherein the applicator element is movable under the force of between 0.01 N and 0.02 N.

6. The applicator of claim 1, wherein the articulation comprises a spherical ball joint fixed to the first portion of the applicator, and a hollow housing complementary to the ball joint and located at the second end of the stem.

7. The applicator of claim 6, wherein the spherical ball joint is force-fitted into the hollow housing.

8. The applicator of claim 6, wherein the housing is made of a plastic material.

9. The applicator of claim 1, wherein the applicator element is made of metal.

10. The applicator of claim 1, wherein the applicator comprises a pipette.

11. The applicator of claim 10, further comprising:
- a duct passing through the stem and the applicator element, the duct including at least one orifice that leads onto a surface of the stem or of the applicator element,
- wherein the applicator element is disposed at least partially inside a container when the applicator engages with the container in a closed position.

12. A device for packaging and applying a cosmetic product, comprising:
- a container configured to contain the cosmetic product and an applicator, wherein the applicator comprises:
- a gripping member;
- a stem defining a longitudinal axis, where a first end of the stem is connected to the gripping member; and
- an applicator element connected to a second end of the stem by an articulation comprising a ball joint linkage and a rotation axis that coincides with the longitudinal axis of the stem,
- wherein the stem is in one piece;
- wherein the applicator element comprises:
  - a ball joint or complementary ball housing at a first portion of the applicator element, and
  - a massage element at a second portion of the applicator element different from the first portion, wherein the massage element comprises a substantially smooth outer surface;
- wherein the applicator element is made of metal, ceramic or glass, and the applicator element is in one piece; and
- wherein the applicator element is configured to be movable in relation to the longitudinal axis of the stem under the effect of its own weight.

13. A method for applying a cosmetic product to a part of a body or face, comprising:
- loading an applicator element of an applicator with a cosmetic product,
- bringing the applicator element into contact with a surface of the body or face,
- moving the applicator in order to apply at least a portion of the cosmetic product to an area of the body or face, and
- modifying the orientation of the applicator element with respect to the stem by changing the pressure exerted on the applicator element, to massage the area of the body or face,
- wherein the applicator comprises:
  - a gripping member;

a stem defining a longitudinal axis, where a first end of the stem is connected to the gripping member; and an applicator element connected to a second end of the stem by an articulation comprising a ball joint linkage and a rotation axis that coincides with the longitudinal axis of the stem, wherein the stem is in one piece;

wherein the applicator element comprises:

a ball joint or complementary ball housing at a first portion of the applicator element, and a massage element at a second portion of the applicator element different from the first portion, wherein the massage element comprises a substantially smooth outer surface;

wherein the applicator element is made of metal, ceramic or glass, the applicator element is in one piece; and wherein the applicator element is configured to be movable in relation to the longitudinal axis of the stem under the effect of its own weight.

* * * * *